US010062943B2

(12) United States Patent
Li

(10) Patent No.: US 10,062,943 B2
(45) Date of Patent: Aug. 28, 2018

(54) MICROSTRIP LINE STRUCTURE AND METHOD FOR FABRICATING THE SAME

(71) Applicant: UNITED MICROELECTRONICS CORP., Hsin-Chu (TW)

(72) Inventor: Tzung-Lin Li, Hsinchu (TW)

(73) Assignee: UNITED MICROELECTRONICS CORP., Hsin-Chu (TW)

( * ) Notice: Subject to any disclaimer, the term of this patent is extended or adjusted under 35 U.S.C. 154(b) by 139 days.

(21) Appl. No.: 15/261,879

(22) Filed: Sep. 10, 2016

(65) Prior Publication Data

US 2018/0076500 A1 Mar. 15, 2018

(51) Int. Cl.
*H01P 3/08* (2006.01)
*H01P 11/00* (2006.01)

(52) U.S. Cl.
CPC ..... *H01P 3/082* (2013.01); *H01P 3/08* (2013.01); *H01P 11/003* (2013.01)

(58) Field of Classification Search
CPC ..... H01P 1/203; H01P 1/20327; H01P 3/02; H01P 3/08; H01P 3/081; H01P 3/082; H01P 3/084; H05K 1/0224; H05K 1/0225; H05K 1/0227
USPC ..... 333/161, 164, 204, 205, 238, 246
See application file for complete search history.

(56) References Cited

U.S. PATENT DOCUMENTS

| | | | | |
|---|---|---|---|---|
| 9,256,038 | B2 | 2/2016 | Han et al. | |
| 9,362,606 | B2 | 6/2016 | Dewitt et al. | |
| 2009/0315641 | A1* | 12/2009 | Ding | H01P 1/184 333/161 |
| 2011/0001504 | A1* | 1/2011 | Cho | G01R 31/2846 324/756.01 |

* cited by examiner

*Primary Examiner* — Rakesh Patel
*Assistant Examiner* — Jorge Salazar, Jr.
(74) *Attorney, Agent, or Firm* — Winston Hsu

(57) ABSTRACT

A method for fabricating microstrip line structure is disclosed. First, a substrate is provided, ground patterns are formed on the substrate, an interlayer dielectric (ILD) layer is formed on the ground patterns, contact plugs are formed in the ILD layer, a ground plate is formed on the ILD layer, and a signal line is formed on the ground plate. Preferably, the ground plate includes openings that are completely shielded by the ground patterns.

14 Claims, 2 Drawing Sheets

MICROSTRIP LINE STRUCTURE AND METHOD FOR FABRICATING THE SAME

BACKGROUND OF THE INVENTION

1. Field of the Invention

The invention relates to a microstrip line structure, and more particularly, to a microstrip line structure having openings of ground plate shielded by ground patterns.

2. Description of the Prior Art

Transmission lines are important elements in circuit applications. For example, transmission lines typically provide the on-chip interconnect between active and passive devices of circuits, and are also utilized as impedance matching elements. A microstrip line is a type of transmission line widely utilized in microwave integrated circuit applications. Specifically, a microstrip line is a type of electrical transmission line that can be fabricated using printed circuit board technology, and may be used to convey microwave-frequency signals. Microwave components such as antennas, couplers, filters, power dividers, etc. can be formed from microstrip lines, the entire device existing as the pattern of metallization on a substrate.

Generally, microstrip lines comprise a signal line over a ground plane, which may be a solid metal plane, with a dielectric layer or layers separating the signal line from the ground plane. The ground plane has the advantageous feature of isolating the signal line from the substrate. Therefore, any substrate-induced losses are reduced. However, the formation of the ground plane also incurs drawbacks. As the scaling of back end of the line (BEOL) processes continues to trend downward, the vertical distance between the signal line and the ground plane becomes significantly smaller. This requires the signal line to be increasingly narrower in order to achieve the desired characteristic impedance. Consequently, insertion losses in microstrip lines become increasingly more significant, and demand better impedance matching between microstrip lines and network devices. Furthermore, the ground plane becomes a barrier for tuning the characteristic impedance of microstrip lines. This is due to the limited vertical distance between the signal line and the ground plane (i.e., a smaller distance with little room for tuning).

Accordingly, there exists a need in the art to overcome the deficiencies and limitations described hereinabove.

SUMMARY OF THE INVENTION

According to a preferred embodiment of the present invention, a method for fabricating microstrip line structure is disclosed. First, a substrate is provided, ground patterns are formed on the substrate, an interlayer dielectric (ILD) layer is formed on the ground patterns, contact plugs are formed in the ILD layer, a ground plate is formed on the ILD layer, and a signal line is formed on the ground plate. Preferably, the ground plate comprises openings shielded by the ground patterns.

According to another aspect of the present invention, a microstrip line structure is disclosed. The microstrip line structure includes: a substrate; ground patterns on the substrate; a ground plate on the substrate, and a signal line on the ground plate. Preferably, the ground plate includes openings shielded by the ground patterns.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
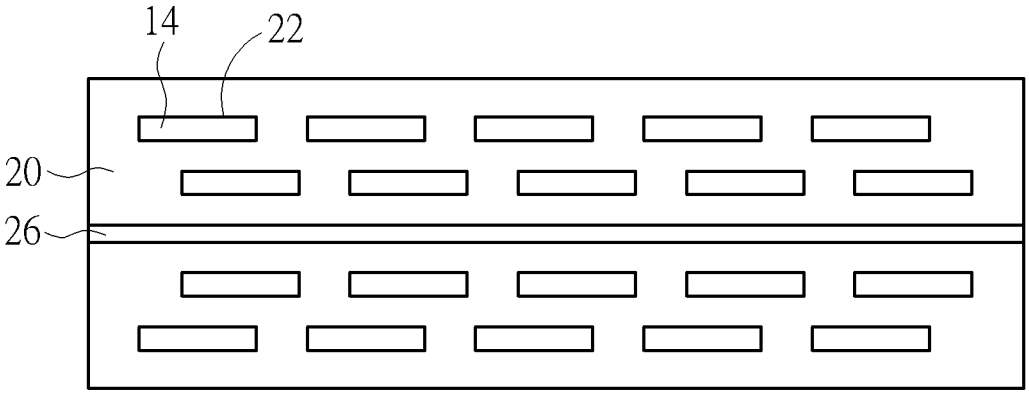
FIG. 1 illustrates a top view of a microstrip line structure according to a preferred embodiment of the present invention.
Figure 2:
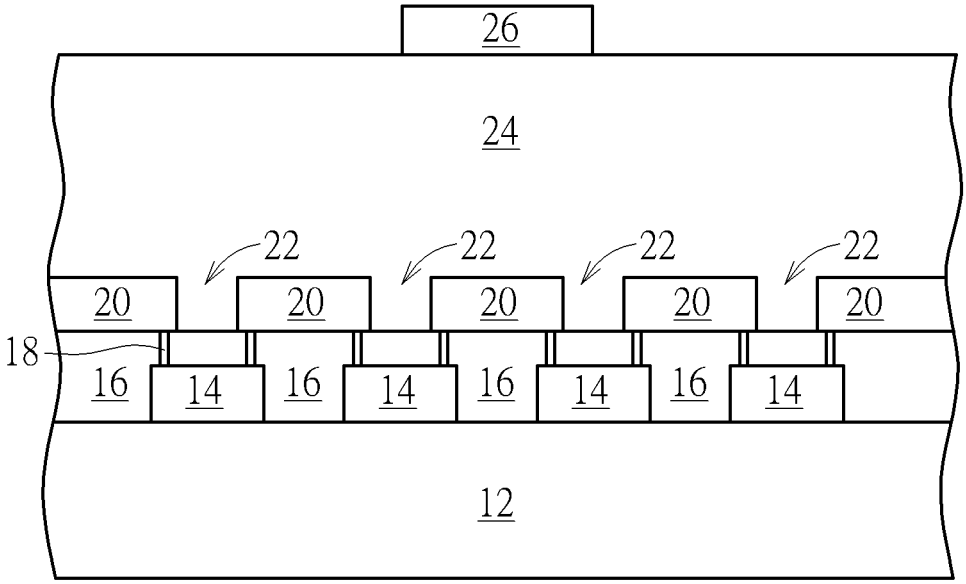
FIG. 2 illustrates a cross-sectional view of a microstrip line structure according to a preferred embodiment of the present invention.

Referring to FIGS. 1-2, FIGS. 1-2 illustrates a method for fabricating a microstrip line structure according to a preferred embodiment of the present invention, in which FIG. 1 illustrates a top view of the microstrip line structure while FIG. 2 illustrates a cross-sectional view of the microstrip line structure. As shown in FIGS. 1-2, a substrate 12 (FIG. 2) is provided and ground patterns 14 (FIG. 2) are formed on the substrate. In this embodiment, the substrate 12 could be a semiconductor substrate such as a silicon substrate, an epitaxial substrate, a SiC substrate, or a silicon-on-insulator (SOI) substrate, but not limited thereto. The ground patterns 14 are preferably composed of polysilicon, which could be fabricated along with polysilicon gate structures belong to metal-oxide semiconductor (MOS) transistors disposed on other parts of the substrate 12 or could be formed independently. Alternatively, the ground patterns 14 could also be made of conductive or metal material including but not limited to for example, Ti, W, Cu, Al, or combination thereof.

Next, an interlayer dielectric (ILD) layer 16 (FIG. 2) is formed on the substrate 12 to cover all the ground patterns 14, and contact plugs 18 are formed in the ILD layer 16 to physically connect to the ground patterns 14. In this embodiment, the ILD layer 16 is preferably made of material such as tetraethyl orthosilicate (TEOS), but not limited thereto.

The formation of the contact plugs 18 (FIG. 2) could be accomplished by first conducting a photo-etching process to remove part of the ILD layer 16 for forming contact holes (not shown) exposing part of the top surfaces of the ground patterns 14, and then sequentially depositing a barrier layer (not shown) and a metal layer (not shown) into the contact holes. The barrier layer and metal layer are then planarized through a chemical mechanic polishing (CMP) process to form contact plugs 18 embedded within the ILD layer 16, in which the top surfaces of the contact plugs 18 and ILD layer 16 are coplanar. In this embodiment, the barrier layer could be selected from the group consisting of Ti, TiN, Ta, and TaN and the metal layer could be selected from the group consisting of W, Cu, Al, TiAl, and CoWP.

Next, a ground plate 20 is formed on the ILD layer 16, in which the ground plate 20 preferably includes openings 22 exposing part of ILD layer 16 surface. An example of the formation of the ground plate 20 could be accomplished by first forming a metal layer (not shown) on the ILD layer 16 through deposition process including but not limited to for example, atomic layer deposition (ALD) process, metal sputtering, or chemical vapor deposition (CVD) process. Next, a photo-etching process is conducted by using a patterned mask to remove part of the metal layer for forming openings 22 exposing part of the ILD layer 16 underneath, in which the position of the openings 22 preferably correspond to the ground patterns 14 underneath while the pattern of the ground patters 14 preferably seal all of the openings 22 when viewed from the top. The ground plate 20 could be made of any metal or metal alloy including but not limited to for example, W, Cu, Al, TiAl, and CoWP.

Next, a dielectric layer 24 is formed on the ground plate 20 and a signal line 26 is formed on the dielectric layer 24 thereafter. In this embodiment, the dielectric layer 24 could be made of material including but not limited to for example, $SiO_2$, SiN, SiON, SiCN, or combination thereof. The dielectric layer 24 could also be an inter-metal dielectric (IMD) layer having metal interconnections (not shown) embedded within the IMD layer on other regions of the substrate 12. An example of the formation of the signal line 26 could be accomplished by first forming a metal layer (not shown) on the dielectric layer 24, and then conducting a photo-etching process by using a patterned mask to remove part of the metal layer for defining a signal line pattern on the dielectric layer 24. Depending on the demand of the product, the signal line 26 and the ground plate 20 could be made of same material or different material. In this embodiment, the signal line 26 could be made of any metal or metal alloy including but not limited to for example, W, Cu, Al, TiAl, and CoWP.

According to a preferred embodiment of the present invention, the openings 22 of the ground plate 20 are shielded by the ground patterns 14 completely when viewed from the top, so that when signals are transmitted from the signal line 26 to the ground plate 20, signal loss through the openings 22 could be minimized.

It should be noted that in alternative to the design of using contact plugs 18 to connect the ground plate 20 and the ground patterns 14, it would also be desirable to eliminate the formation of contact plugs 18 so that the ground plate 20 and the ground patterns 14 are not electrically or physically connected in any way. In other words, it would also be desirable to first form ground patterns 14 on a substrate 12, cover the ground patterns 14 with ILD layer 16, and then form ground plate 20 on the ILD layer 16 with openings 22 shielded by the ground patterns 14. In this instance, the ground plate 20 would be floating above the ILD layer 16 without contacting any contact plug or interconnections, which is also within the scope of the present invention.

Moreover, according to an embodiment of the present invention, instead of forming the ground patterns 14 directly on the substrate 12, it would also be desirable to form at least a dielectric layer on the substrate 12 before forming the ground patterns 14, so that the ground patterns 14 would be formed directly on an ILD layer or an IMD layer instead of the substrate 12, which is also within the scope of the present invention.

Figure 3:
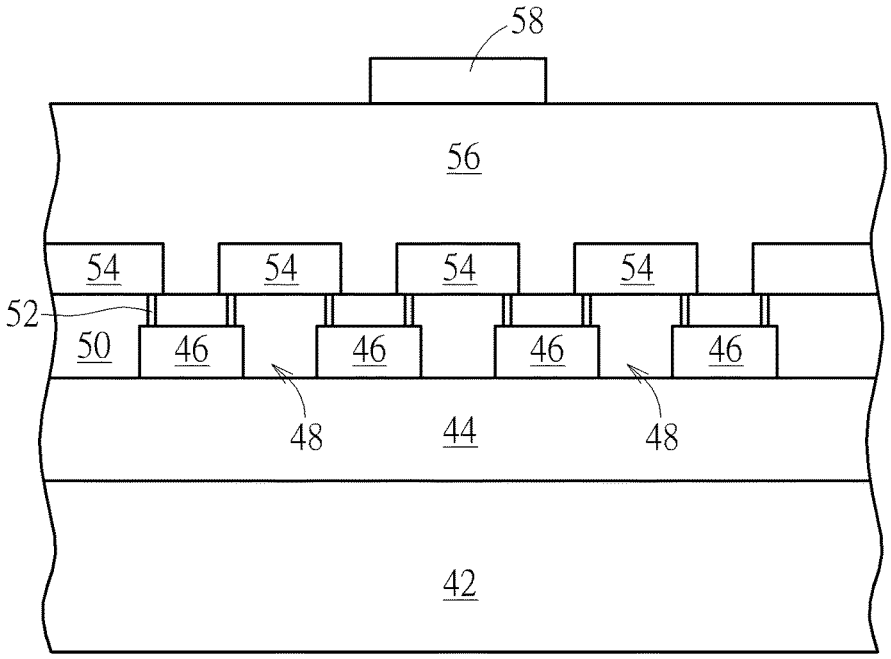
FIG. 3 illustrates a method for fabricating a microstrip line structure according to an embodiment of the present invention.

Referring to FIG. 3, FIG. 3 illustrates a method for fabricating a microstrip line structure according to an embodiment of the present invention. As shown in FIG. 3, a substrate 42 is provided, in which the substrate 42 could be a semiconductor substrate including a silicon substrate, an epitaxial substrate, a SiC substrate, or a silicon-on-insulator (SOI) substrate, but not limited thereto. At least an active device such as a metal-oxide semiconductor (MOS) transistor could be formed on other parts of the substrate 42, in which the MOS transistor could include typical transistor elements such as gate structure, spacer, source/drain region, silicides, and epitaxial layers.

Next, an interlayer dielectric (ILD) layer 44 is formed on the substrate 42, and a ground plate 46 is formed on the ILD layer 44, in which the ground plate 46 preferably includes openings 48 exposing part of ILD layer 44 surface. An example for forming of the ground plate 46 includes first forming a metal layer (not shown) on the ILD layer 44 through deposition process including but not limited to for example, atomic layer deposition (ALD) process, metal sputtering, or chemical vapor deposition (CVD) process. Next, a photo-etching process is conducted by using a patterned mask to remove part of the metal layer for forming openings 48 exposing part of the ILD layer 44 underneath. In this embodiment, the ILD layer 44 is preferably made of material such as tetraethyl orthosilicate (TEOS), but not limited thereto. The ground plate 46 could be made of any metal or metal alloy including but not limited to for example, W, Cu, Al, TiAl, and CoWP.

Next, a dielectric layer 50 is formed on the ILD layer 44 to cover the ground plate 46, and contact plugs 52 are formed in the dielectric layer 50.

The formation of the contact plugs 52 could be accomplished by first conducting a photo-etching process to remove part of the dielectric layer 50 for forming contact holes (not shown) exposing part of the top surfaces of the ground plate 46, and then sequentially depositing a barrier layer (not shown) and a metal layer (not shown) into the contact holes. The barrier layer and metal layer are then planarized through a chemical mechanic polishing (CMP) process to form contact plugs 52 embedded within the dielectric layer 50, in which the top surfaces of the contact plugs 52 and dielectric layer 50 are coplanar. In this embodiment, the barrier layer could be selected from the group consisting of Ti, TiN, Ta, and TaN and the metal layer could be selected from the group consisting of W, Cu, Al, TiAl, and CoWP.

Next, ground patterns 54 are formed on the dielectric layer 50 to shield the openings 48 within the ground plate 46. The ground patterns 54 are preferably composed of polysilicon, which could be fabricated along with polysilicon gate structures belong to metal-oxide semiconductor (MOS) transistors disposed on other parts of the substrate 12 or could be formed independently. Alternatively, the ground patterns 14 could also be made of conductive or metal material including but not limited to for example, Ti, W, Cu, Al, or combination thereof.

Next, another dielectric layer 56 is formed on the dielectric layer 50 to cover the ground patterns 54, and a signal line 58 is formed on the dielectric layer 56. Similar to the aforementioned embodiment, the signal line 58 and the ground plate 46 could be made of same material or different material. In this embodiment, the signal line 58 could be made of any metal or metal alloy including but not limited to for example, W, Cu, Al, TiAl, and CoWP.

Similar to the aforementioned embodiment, in alternative to the design of using contact plugs 52 to connect the ground plate 46 and the ground patterns 54, it would also be desirable to eliminate the formation of contact plugs 52 so that the ground plate 46 and the ground patterns 54 are not electrically or physically connected in any way. In other words, it would also be desirable to first form ground plate 46 on the ILD layer 44, cover the ground plate 46 with dielectric layer 50, and then form ground patterns 54 on the dielectric layer 50 to shield the openings 48 within the ground plate 46, which is also within the scope of the present invention.

Figure 4:
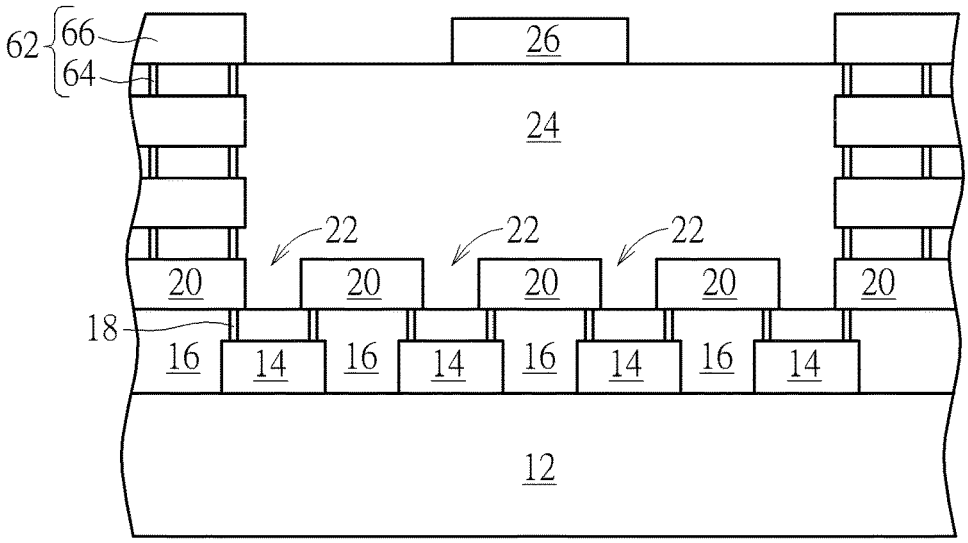
FIG. 4 illustrates a structural view of a microstrip line structure according to an embodiment of the present invention.

Referring to FIG. 4, FIG. 4 illustrates a structural view of a microstrip line structure according to an embodiment of the present invention. As shown in FIG. 4, a variation of the microstrip line structure shown in FIGS. 1-2 typically known as a coplanar waveguide with ground (CPWG) type microstrip line structure is disclosed. Similar to the embodiment disclosed in FIG. 2, the CPWG microstrip line structure also includes ground patterns 14 on a substrate 12, an ILD layer 16 on the ground patterns 14, a ground plate 20 on the ILD layer 16 and electrically connected to the ground patterns 14 through the contact plugs 18, a dielectric layer 24 on the ground plate 20, and a signal line 26 on the dielectric layer 24. In this embodiment, the ground plate 20 adjacent to two sides of the signal line 26 is further extended upward through metal interconnections 62 within the dielectric layer 24. The extension of the ground plate 20 or the metal interconnections 62 preferably include via conductors 64 and trench conductors 66, in which the topmost trench conductors 66 adjacent to two sides of the signal line 26 are preferably on the same level as the signal line 26.

In this embodiment, the formation of the via conductors 64 and trench conductors 66 could be accomplished by a dual damascene process and each of the via conductors 64 and trench conductors 66 could at least include a barrier layer (not shown) and a metal layer (not shown). The barrier layer could be selected from the group consisting of Ti, TiN, Ta, and TaN and the metal layer could be selected from the group consisting of W, Cu, Al, TiAl, and CoWP. Since the fabrication of via conductors and trench conductors through dual damascene process is well known to those skilled in the art, the details of which are not explained herein for the sake of brevity.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for fabricating microstrip line structure, comprising:
providing a substrate;
forming ground patterns on the substrate;
forming a ground plate on the substrate, wherein the ground plate comprises openings shielded by the ground patterns and part of the ground patterns shielding the openings also overlapping part of the ground plate; and
forming a signal line above the ground plate.

2. The method of claim 1, further comprising:
forming an interlayer dielectric (ILD) layer on the ground patterns;
forming contact plugs in the ILD layer;
forming the ground plate on the ILD layer and electrically connecting the ground plate to the ground patterns through the contact plugs.

3. The method of claim 2, further comprising:
forming a dielectric layer on the ground plate; and
forming the signal line on the dielectric layer.

4. The method of claim 1, further comprising:
forming an interlayer dielectric (ILD) layer on the substrate;
forming the ground plate on the ILD layer;
forming contact plugs on the ground plate; and
forming the ground patterns on the contact plugs to shield the openings of the ground plate.

5. The method of claim 4, further comprising:
forming a dielectric layer on the ground patterns; and
forming the signal line on the dielectric layer.

6. The method of claim 1, wherein the ground patterns comprise metal.

7. The method of claim 1, wherein the ground patterns comprise polysilicon.

8. A microstrip line structure, comprising:
a substrate;
ground patterns on the substrate;
a ground plate on the substrate, wherein the ground plate comprises openings shielded by the ground patterns and part of the ground patterns shielding the openings also overlapping part of the ground plate; and
a signal line above the ground plate.

9. The microstrip line structure of claim 8, further comprising:
an interlayer dielectric (ILD) layer on the ground patterns;
contact plugs in the ILD layer;
the ground plate on the ILD layer and the ground plate being electrically connected to the ground patterns through the contact plugs.

10. The microstrip line structure of claim 9, further comprising:
a dielectric layer on the ground plate; and
the signal line on the dielectric layer.

11. The microstrip line structure of claim 8, further comprising:
an interlayer dielectric (ILD) layer on the substrate;
the ground plate on the ILD layer;
contact plugs on the ground plate; and
the ground patterns on the contact plugs to shield the openings of the ground plate.

12. The microstrip line structure of claim 11, further comprising:
a dielectric layer on the ground patterns; and
the signal line on the dielectric layer.

13. The microstrip line structure of claim 8, wherein the ground patterns comprise metal.

14. The microstrip line structure of claim 8, wherein the ground patterns comprise polysilicon.

* * * * *